US006418230B1

(12) United States Patent
McDonald et al.

(10) Patent No.: US 6,418,230 B1
(45) Date of Patent: Jul. 9, 2002

(54) FLEXIBLE EARHOOK

(75) Inventors: James T. McDonald, Pepperell, MA (US); Joseph L. Freni, Hudson, NH (US); John Depiano, Burlington; Roy Heinz, Waltham, both of MA (US)

(73) Assignee: GN Netcom/Unex Inc., Nashua, NH (US)

( * ) Notice: Subject to any disclaimer, the term of this patent is extended or adjusted under 35 U.S.C. 154(b) by 0 days.

(21) Appl. No.: 09/197,101

(22) Filed: Nov. 20, 1998

(51) Int. Cl.[7] ..... H04R 25/00

(52) U.S. Cl. ..... 381/381; 381/330; 381/395; 379/426

(58) Field of Search ..... 381/327, 330, 381/370, 374, 379, 381, 395; 379/426, 430, 431

(56) References Cited

U.S. PATENT DOCUMENTS

| | | | | |
|---|---|---|---|---|
| 1,587,643 | A | | 6/1926 | Harman |
| 2,474,135 | A | | 6/1949 | White |
| 2,481,387 | A | | 9/1949 | Bonecutter |
| 2,485,405 | A | | 10/1949 | Olney et al. |
| 2,506,490 | A | | 5/1950 | Edgewood |
| 2,513,746 | A | * | 7/1950 | Rohr ..... 381/330 |
| 2,586,644 | A | | 2/1952 | Gilbert |
| 2,606,255 | A | | 8/1952 | Tullis |
| 2,939,923 | A | | 6/1960 | Henderson |
| 3,123,678 | A | * | 3/1964 | Prentiss et al. ..... 381/330 |
| 3,440,365 | A | | 4/1969 | Bryant et al. |
| 3,682,268 | A | | 8/1972 | Gesellschaft |
| 3,862,378 | A | | 1/1975 | Norris |
| D237,090 | S | | 10/1975 | Yauagawa |
| 3,993,879 | A | | 11/1976 | Larkin |
| 4,020,297 | A | | 4/1977 | Brodie |
| 4,273,969 | A | | 6/1981 | Foley et al. |
| 4,335,281 | A | | 6/1982 | Scott et al. |
| D272,904 | S | | 3/1984 | Kawano |
| 4,453,050 | A | | 6/1984 | Enokido |
| 4,702,345 | A | | 10/1987 | Janssen et al. |
| D293,107 | S | | 12/1987 | Muller |
| 4,720,857 | A | | 1/1988 | Burris et al. |
| 4,763,753 | A | | 8/1988 | Killion |
| 4,875,233 | A | | 10/1989 | Derhaag et al. |
| 4,893,344 | A | | 1/1990 | Tragardh et al. |
| D311,521 | S | | 10/1990 | Jonsson et al. |
| D326,653 | S | | 6/1992 | Hino |
| 5,134,655 | A | | 7/1992 | Jensen |
| 5,210,792 | A | * | 5/1993 | Kajihara ..... 381/381 |
| 5,298,692 | A | | 3/1994 | Ikeda |
| D357,479 | S | | 4/1995 | Coomans |
| 5,412,736 | A | * | 5/1995 | Keliiliki ..... 381/381 |
| 5,446,788 | A | | 8/1995 | Lucey et al. |
| 5,450,496 | A | * | 9/1995 | Burris et al. ..... 381/381 |
| D375,313 | S | | 11/1996 | Jensen et al. |

(List continued on next page.)

FOREIGN PATENT DOCUMENTS

| | | |
|---|---|---|
| AU | 436377 | 10/1926 |
| EP | 158391 | 3/1984 |
| GB | 1377237 | 12/1974 |
| GB | 2036505 | 6/1980 |
| JP | 60-10999 | 1/1985 |
| WO | 90/10361 | 9/1990 |

*Primary Examiner*—Huyen Le
*Assistant Examiner*—Suhan Ni
(74) *Attorney, Agent, or Firm*—Altera Law Group LLC

(57) ABSTRACT

A flexible earhook for positioning an earphone adjacent a wearer's ear, the earhook including a mounting element capable of being provided with the earphone. The mounting element may be substantially annular. The earhook further includes a hook element comprising a material capable of being contoured and thereafter maintaining its shape. The hook element may comprise a wire. The hook element and the mounting element may be connected such that the flexible earhook can be used on either ear.

9 Claims, 5 Drawing Sheets

U.S. PATENT DOCUMENTS 5,606,621 A * 2/1997 Reiter et al. ..... 381/330
5,625,171 A 4/1997 Marshall
4,048,453 A 9/1997 Seidel
D385,272 S 10/1997 Jensen et al.
5,708,724 A 1/1998 Burns et al.
5,757,944 A 5/1998 Jensen et al.
5,790,683 A * 8/1998 Salzani ..... 381/381
5,796,821 A 8/1998 Crouch et al.
D403,327 S 12/1998 Landreth et al.
5,881,161 A * 3/1999 Liu ..... 381/381
6,104,824 A * 8/2000 Ito ..... 381/381

* cited by examiner

FLEXIBLE EARHOOK

FIELD OF THE INVENTION

The invention relates to earhooks, and in particular to flexible earhooks that may be contoured to a wearer's ear.

BACKGROUND OF THE INVENTION

Traditionally, earphones have been used by positioning a support member or band across the wearer's head, whereby the earphones rest against the outer vicinity of the ears and the wearer perceives the audio produced in the earphone. When it is desirable for the wearer to be able to perceive also ambient sound and engage in direct conversations, one of the earphones has been replaced by a pad that rests against the side of the head. While perceiving sound through the one earphone which is positioned against one ear, the wearer can still hear ambient sound with the other ear.

However, the support member extending across the wearer's head has disadvantages. It may product unwanted pressure on the wearer's head, and it may also interfere with the person's hair. Furthermore, some wearers find it uncomfortable having an object extending over the top of their head, further adding to the disadvantages of such structures.

Prior art earphones which hang from the outer ear (lat. pinna) are not flexible, that is, they are typically made from hard plastic materials which severely restrict the amount of adjustment the wearer can make. This may render the earphone uncomfortable, which may cause the wearer to frequently readjust the earphone for a more comfortable fit.

Being able to offer the wearer an adjustable earhook allows the wearer to contour the earhook to reflect the shape of the individual wearer's ear. Doing so greatly improves the wearer's comfort, in that the wearer is able to adjust the earhook to a personal comfortable fit. Good adjustability and comfort for the wearer is particularly important in a professional situation where the earphone is intended to be used for extended periods of time.

Thus, it can be seen that there is a need for an earhook which allows a lightweight, accessible, and easily adjustable arrangement of an earphone close to the wearer's ear.

SUMMARY OF THE INVENTION

The present invention relates generally to earhooks, and in particular to flexible earhooks that may be contoured to a wearer's ear.

A flexible earhook for positioning an earphone adjacent a wearer's ear comprises a mounting element capable of being provided with the earphone, and a hook element comprising a material capable of being contoured and thereafter maintaining its shape. The hook element and the mounting element may be connected such that the flexible earhook can be used on either ear.

In one embodiment, the mounting element comprises a hard plastic material. In another embodiment, the hook element comprises a soft pliable plastic material facing the wearer's ear.

In one embodiment, the longitudinal member includes a curved portion between the first and second ends. In another embodiment, the material capable of being shaped and thereafter maintaining its shape comprises a wire. The wire may be covered with a soft plastic material.

In yet another embodiment, the hook element and the mounting element are connected by a substantially cylindrical portion on the mounting element and by a hollow, substantially cylindrical housing on the hook element, wherein the cylindrical portion has a radially extending flange, and the housing having a plurality of slits to accommodate the flange.

These and various other advantages and features of novelty which characterize the present invention are pointed out with particularity in the claims annexed hereto and forming a part hereof. However, for a better understanding of the present invention, its advantages, and other objects obtained by its use, reference should be made to the drawings which form a further part hereof, and to the accompanying descriptive matter, in which preferred embodiments of the present invention are illustrated and described.

BRIEF DESCRIPTION OF THE DRAWINGS

The present invention will be described with reference to the accompanying drawings, wherein like reference numerals identify corresponding or like components.

DETAILED DESCRIPTION OF THE DRAWINGS

Figure 1:
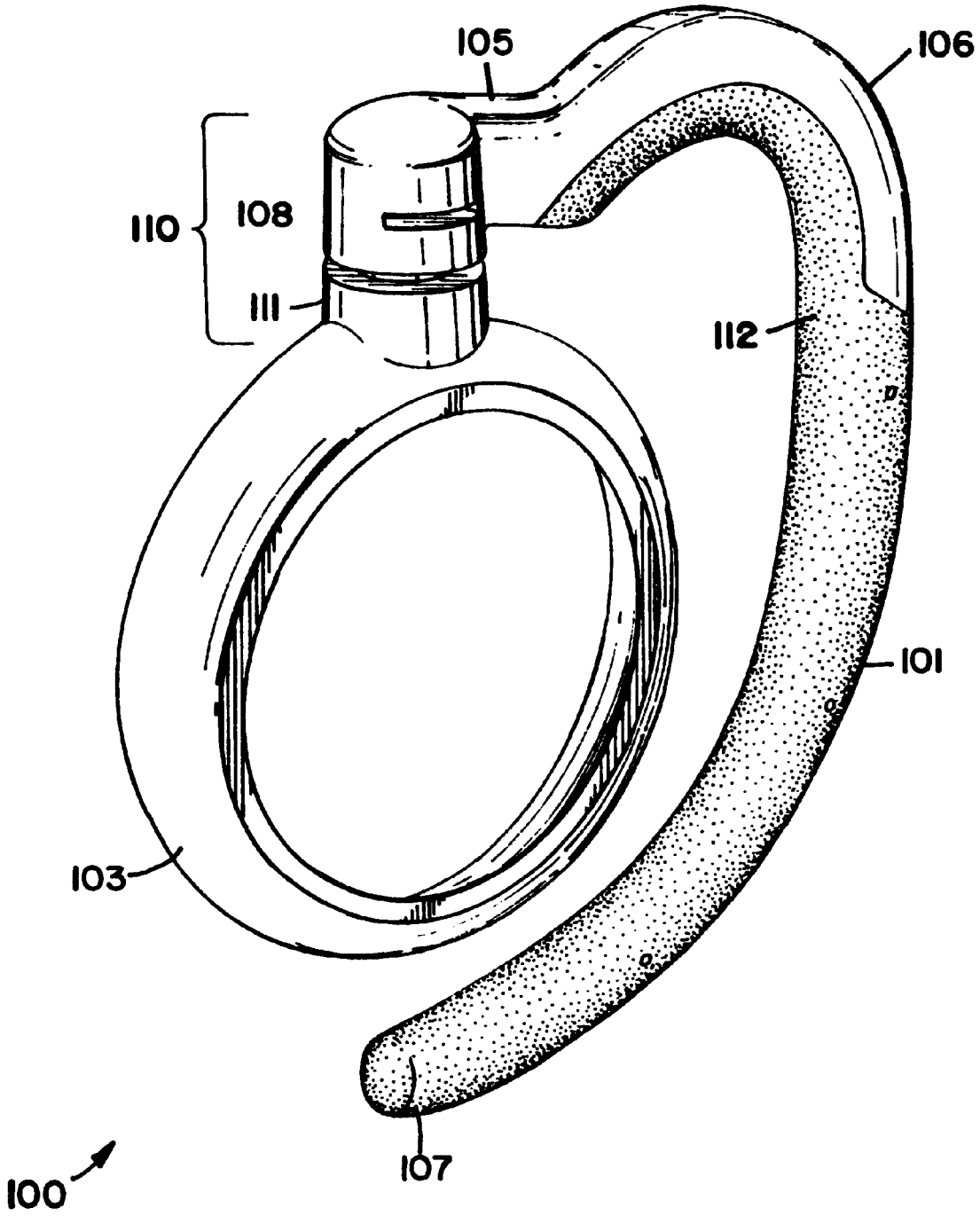
FIG. 1 is a perspective view of an embodiment of the present invention.

FIG. 1 shows a flexible earhook 100 in one embodiment of the present invention. The earhook 100 generally comprises a hook element 101 and a mounting element 103. The hook element 101 may be used to position the earhook 100 on a wearer's ear. The hook element 101 may be connected to the mounting element such that the earhook 100 may rotate, that is, the earhook 101 may be used with either left or right ear. The mounting element 103 may be used for mounting an earphone or similar equipment, such that the earphone is positioned adjacent the wearer's ear when wearing the earhook 100. The hook element 101 is flexibly adjustable, which allows a wearer to adjust it to conform comfortably to the shape of his or her ear.

The hook element 101 comprises a first end 105 and a second end 107. The hook element 101 further comprises a first connection member 108 which may, for example, be used for connecting the hook element 101 to the mounting element 103. Between the first end 105 and the second end 107 is a longitudinal portion including a curved portion 106. The curved portion 106 may be shaped to make the fitting of the earhook 100 onto the wearer's ear comfortable.

As shown by the shaded area 112 in FIG. 1, the hook element 101 may comprise one material on portions adjacent the wearer's ear. The material may be a soft pliable plastic material, for example a SANTOPRENE material. This may serve to increase the comfort of using the earhook 100.

In the illustrated embodiment, the curved portion 106 extends down along the back of the hook element 101. When the curved portion 106 is formed from a hard plastic material, this may serve to facilitate the wearer's contouring of the hook element 101 in order for the earhook 100 to fit comfortably. The curved portion 106 of a hard plastic material may more or less resist flexing when the portion 112 is being contoured, maintaining the curved portion 106 in substantially original shape.

The mounting element 103 has a substantially annular shape, and comprises a second connection member 111. In the shown embodiment, the second connection member 111 is positioned substantially radially with respect to the mounting element 103. The second connection member 111 will extend into the first connection member 108 and together they form an earhook register 110 which allows the mounting element 103 to be positioned at angles with respect to hook element 101. This allows, for example, an earphone which may be mounted on the mounting element 103, to be adjusted relative to the wearer's ear as desired. As illustrated, the earhook register 110 may be a swivel mechanism. In other embodiments, other configurations such as hinge mechanisms may be used.

The second connection member 111 may have different configurations. For example, in one embodiment the second connection member 111 may enclose the first connection member 108.

In other embodiments the mounting element 103 may have a shape suitable for the particular equipment, such as an earphone, which is to be mounted on the mounting element 103. It is contemplated that the mounting element 103 need not necessarily enclose or cover the earphone etc.; in some embodiments it may comprise a fitting which attaches to the earphone etc.

The mounting element 103 may be formed using well-known techniques. The mounting element 103 may comprise, for example, a hard plastic material. An example of such a material is a XENOY material.

Figure 2:
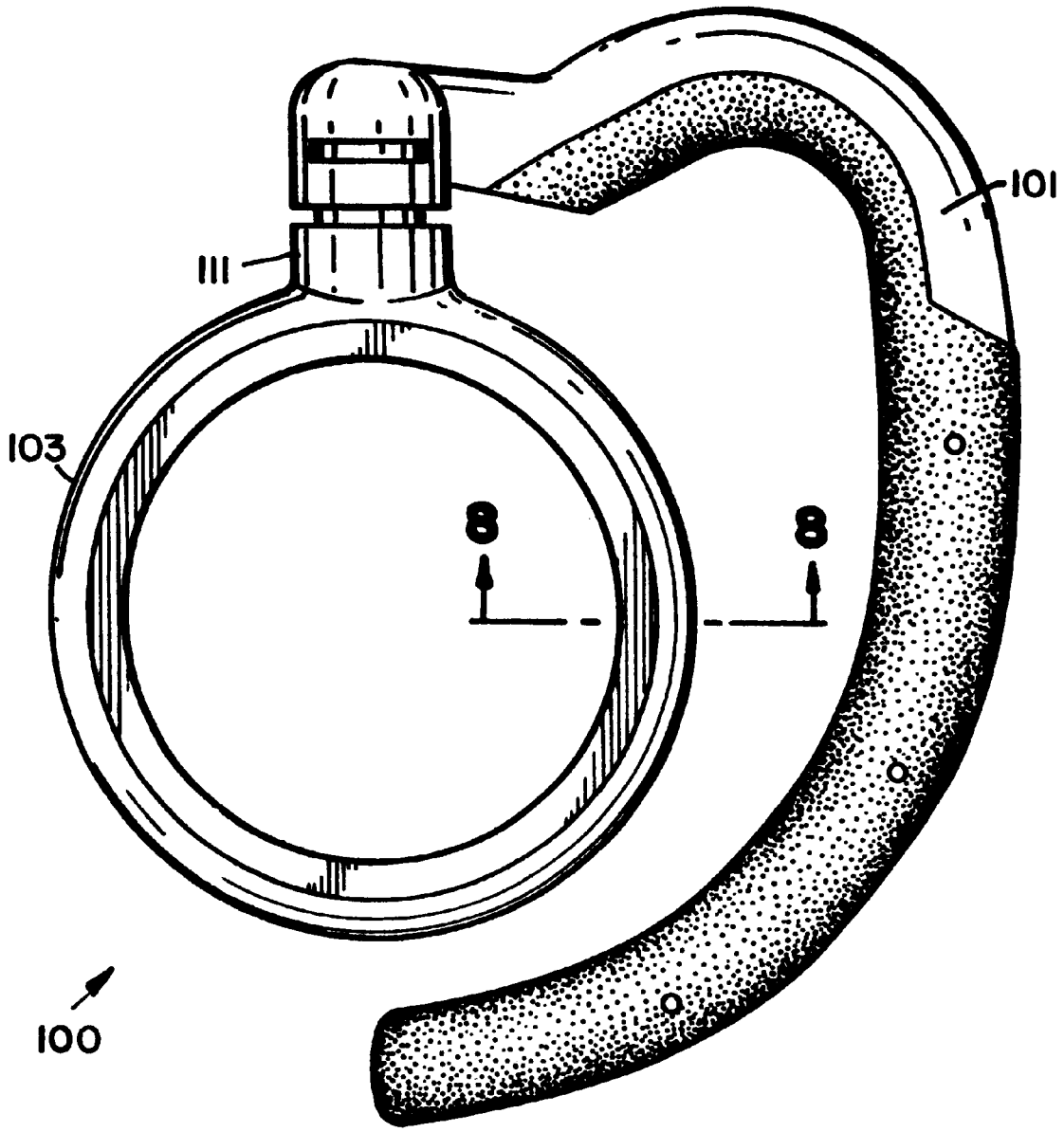
FIG. 2 is a front view of the embodiment of the present invention.
Figure 3:
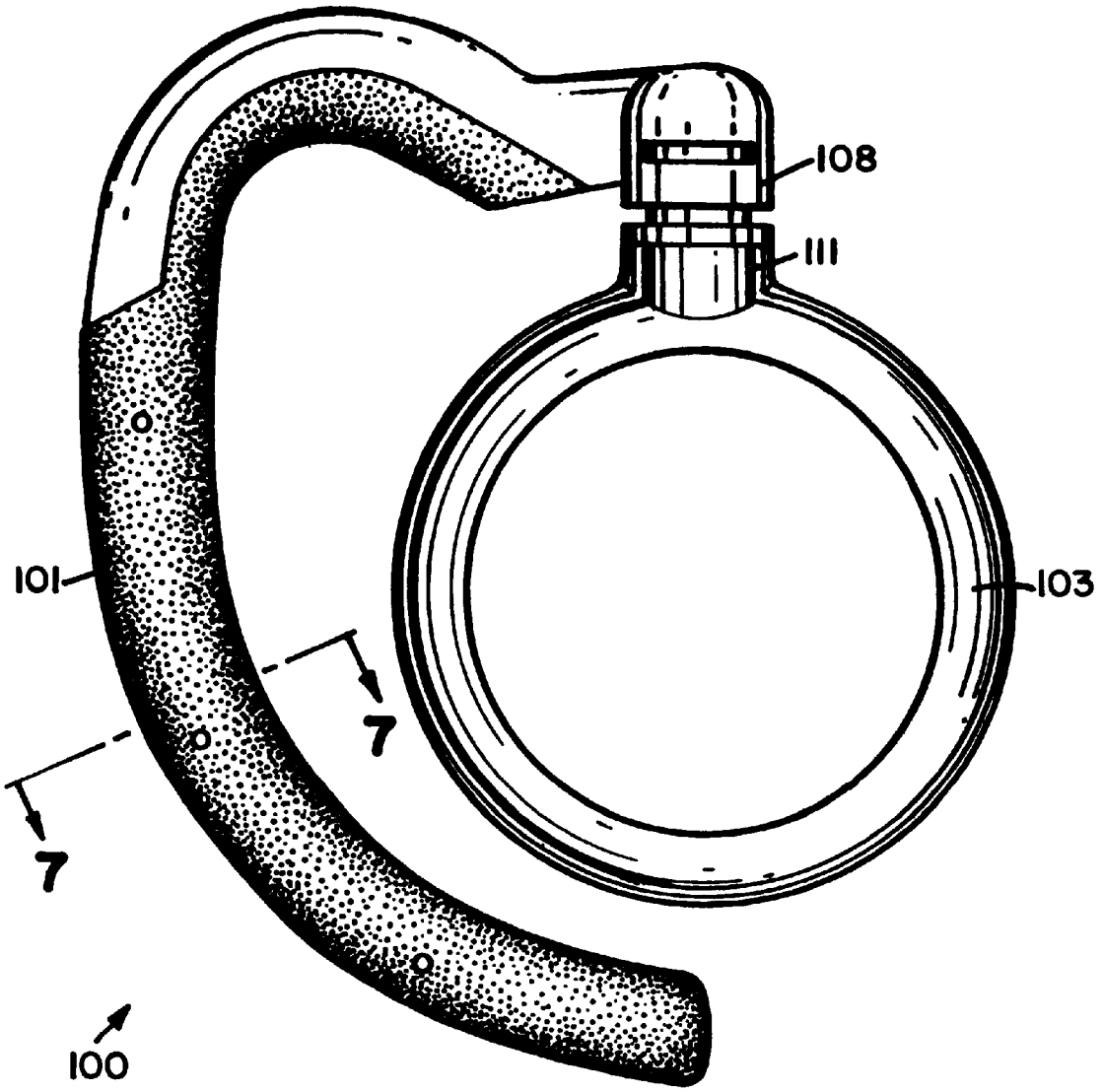
FIG. 3 is a rear view of the embodiment of the present invention.

FIGS. 2 and 3 show front and rear views of the flexible earhook 100, respectively. In the shown configuration of the earhook 100, the first connection member 108 and the second connection member 111 are positioned so that the mounting element 103 is substantially planar with the hook element 101. The mounting element 103 is connected to the hook element 101 such as to be rotatably positionable with respect to the hook element 101. Thus, when wearers put on the earhook 100, the hook element 101 and the mounting element 103 will assume positions with respect to each other.

Figure 5:
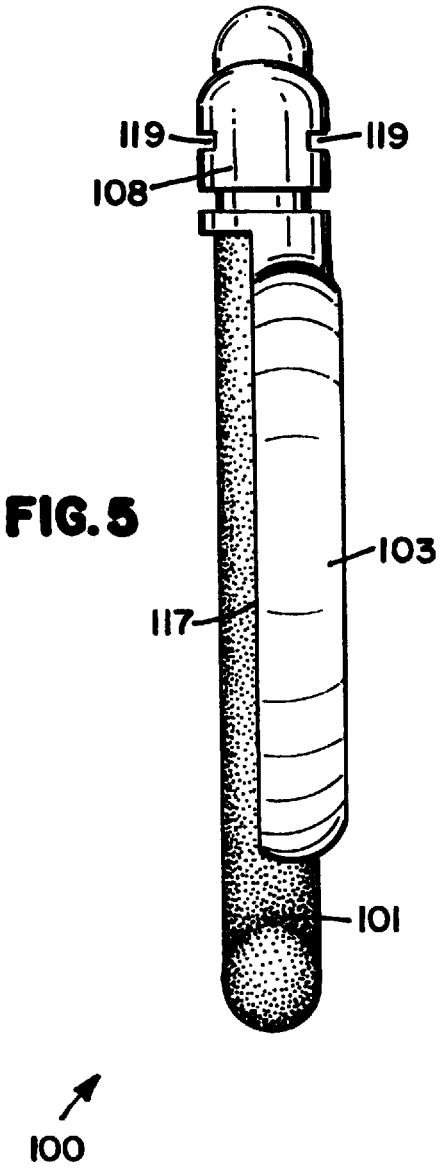
FIG. 5 is a second side view of the embodiment of the present invention.
Figure 4:
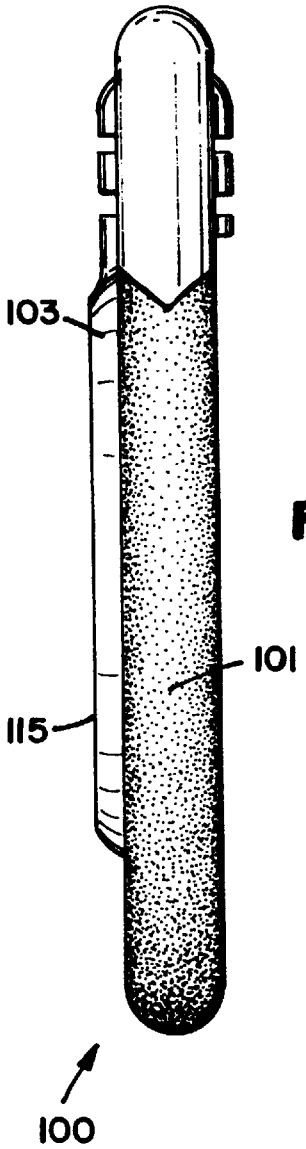
FIG. 4 is a first side view of the embodiment of the present invention.

FIGS. 4 and 5 show side views of the earhook 100, where the mounting elements 103 is adjusted in a position substantially planar with the hook element 101. The mounting element 103 has a first annular edge 115, which may be configured so as to facilitate mounting of a device on the mounting element 103, such as an earphone.

The mounting element 103 further comprises a second annular edge 117, which may be adapted to facilitate the mounting of a device in the mounting element 103. For example, one or both of the first and second angular edges 115 and 117 may be configured to abut or engage a portion of an earphone mounted on the mounting element 103, such that the earphone is securely fastened the mounting element 103.

Slits 119 may be formed in the first connection member 108 to facilitate connection of the hook element 103 such that it is rotatably mounted to the hook element 101. Forming the slits 119 as through openings may be advantageous in that it simplifies the manufacturing process. However, it should be noted that the slits 119 may be formed with different configurations, such as being grooves on the inside of the first connection member 108. The slits 119 may be formed using well-known techniques.

Figure 6:
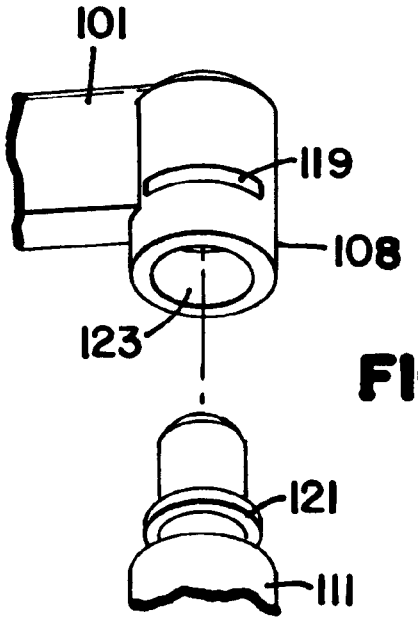
FIG. 6 is a perspective view showing an earhook register of an embodiment in accordance with the present invention.

FIG. 6 shows an embodiment of the first and second connection members 108 and 111. The first connection member 108 comprises a substantially cylindrical cavity 123, and slits 119 in the first connection member 108.

The second connection member 111 comprises a flange 121. The flange 121 may, for example, extend around the entire second connection member 111. The flange 121 will be used to facilitate mounting of the second connection member 111 inside the first connection member 108. This may, for example, be carried out by the flange 121 engaging the slits 119, thereby securing the second connection member 111 to the first connection member 108, and allowing it to be adjusted into different positions.

Figure 7:
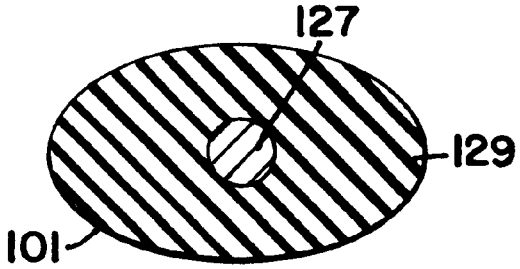
FIG. 7 is a cross section of the hook element in the embodiment shown in FIG. 3, taken along line 7—7.

FIG. 7 shows an exemplary cross section of the hook element 101, taken along the line indicated in FIG. 3. The hook element 101 comprises a core 127 covered by a body 129. The core 127 will act as a flexibly adjustable member which allows the hook element 101 to be flexed into different configurations. For example, the core 127 may render the hook element 101 capable of being contoured and thereafter maintaining its shape. Many different materials may be used for the core member 127. For example, the core member 127 may be a wire with a substantially circular cross section. As another example, the core member 127 may be an annealed wire. The core member 127 may be provided with other cross sections than circular. The body 129 may have other cross sectional configurations than the one shown in the drawing. For example, the body 129 may have a substantially wedge-like cross section, with rounded edges to make it comfortable to use. It should be noted that the core member 127 may constitute a lesser or greater proportion of the entire cross-sectional area of the hook element 101.

The body 129 may, for example, be a soft plastic material such as a thermoelastic material. One example of such a material is a SANTOPRENE material. The body 129 is molded to the core member 127, in order to allow it to flexibly conform to any particular configuration in which the core member 127 may be contoured. In other embodiments, the hook element 101 may be formed entirely from one material which renders it capable of being contoured to the wearer's ear and thereafter maintaining its shape.

In some embodiments, the core member may extend substantially along the entire length of the hook element 101. In another embodiment, it may terminate somewhat before the end of the hook element 101.

In some embodiments, part of the hook element 101 may be formed from a hard plastic material, and another part, such as one which comes in contact with the wearer's skin, may be formed from a soft pliable plastic material. This may, for example, allow the hook element 101 to be used with great comfort for the wearer, as well as with adequate rigidity and structural integrity for the intended use. The hook element 101 may be molded and/or formed using well known techniques.

Figure 8:
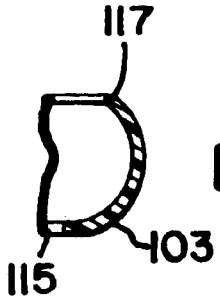
FIG. 8 is a cross section of the mounting element in the embodiment shown in FIG. 2, taken along line 8—8.

FIG. 8 shows a cross section of the mounting element 103 taken along the line indicated in FIG. 2. In this embodiment, the first annular edge 115 and the second annular edge 117 have been configured particularly to facilitate the mounting of a device in the mounting element 103, allowing the device to be positioned adjacent the wearer's ear by means of the earhook 100.

In an exemplary use of the earhook 100, a wearer may place the hook element 101 behind the ear, whereby the mounting element 103 and an earphone mounted thereon are situated approximately in front of the person's ear. If the wearer wishes to adjust the earhook, he or she may contour the hook element 101 to conform to the shape of the ear, whereby the earhook 100 can be worn with a comfortable fit adapted to the person's ear. The mounting element may furthermore be contoured before putting on the earhook 100, and the fit may then be adjusted once it is in place.

While the invention has been described in connection with an embodiment, it will be understood that the invention is not limited to that embodiment. The invention is intended to cover all alternatives, modifications and equivalents as may be included within the spirit and scope thereof, as defined by the appended claims.

We claim:

1. A flexible earhook for positioning an earphone adjacent a wearer's ear, the flexible earhook comprising:

a mounting element capable of being provided with the earphone; and a hook element connected to the mounting element, said hook element having a first generally rigid portion and a second generally flexible portion extending from said first portion, said flexible portion being capable of maintaining its shape in response to positioned by a user and wherein the hook element and the mounting element are connected by a substantially cylindrical portion on the mounting element and by a hollow, substantially cylindrical housing on the hook element, wherein the cylindrical portion has a radially extending flange, and the housing having a plurality of slits to accommodate the flange.

2. The flexible earhook of claim 1, wherein said flexible portion includes a central core comprising a flexibly adjustable wire capable of being positioned by the user and then capable of maintaining it is shape.

3. The flexible earhook of claim 2, wherein said flexible portion includes a soft portion covering said wire to provide a cushioned surface for the wearer.

4. The flexible earhook of claim 3 wherein said soft portion has a generally elliptical cross-section.

5. The flexible earhook according to claim 1, wherein said rigid portion includes a first section being affixed to said mounting element and having an upper surface of rigid material and a lower surface positioned to contact the wearer's ear being soft to provide a cushioned surface for the wearer.

6. The flexible earhook according to claim 5 wherein said rigid portion is rotatably affixed to said first section.

7. The flexible earhook of claim 1, wherein a soft portion extends continuously between said rigid and flexible portions.

8. The flexible earhook of claim 1, wherein the hook element and the mounting element are connected such that the flexible earhook can be used on either ear.

9. A flexible earhook for positioning an earphone adjacent a wearer's ear, the flexible earhook comprising:

a) a mounting element capable of receiving and retaining an earphone;

b) a rotatable swivel member extending generally perpendicularly from said mounting element about an axis extending upwardly from said mounting element, said rotatable member having a top surface distance from said mounting element and having a radially extending flange;

c) a hook element having a substantially cylindrical housing with a plurality of slits to accommodate the flange, to be connected to said rotatable swivel member, said hook element having a first generally rigid portion and a second generally flexible portion extending from said first portion, and wherein said rigid portion Includes a radiused portion extending away from said swivel member and sloping upwardly, so that said raidiused portion resides substantially in a plane above the top of said swivel member.

* * * * *